United States Patent [19]

LaBate

[11] Patent Number: 4,606,458

[45] Date of Patent: Aug. 19, 1986

[54] JEWELRY HOLDING DEVICE

[76] Inventor: Lisa V. LaBate, Chippewa Riviera Condo 1102, 2902-2910 Darlington Rd., Beaver Falls, Pa. 15101

[21] Appl. No.: 742,871

[22] Filed: Jun. 10, 1985

[51] Int. Cl.[4] ..... B65D 73/00; D05C 1/04; D06C 3/08

[52] U.S. Cl. ..... 206/566; 206/495; 206/486; 206/477; 206/481; 38/102.2; 38/102.91

[58] Field of Search ..... 206/566, 495, 489, 488, 206/486, 477, 44.11, 481, 483, 45.19; 211/13; 38/102.2, 102.91; 160/380, 378; D33/32 G

[56] References Cited

U.S. PATENT DOCUMENTS

| | | | |
|---|---|---|---|
| 3,678,607 | 7/1972 | Tabor et al. | 38/102.91 |
| 3,885,333 | 5/1975 | Zachary | 38/102.2 |
| 3,930,702 | 1/1976 | Pichowicz | 206/566 |
| 4,181,224 | 1/1980 | Aber | 206/566 |
| 4,209,212 | 6/1980 | McGoldrick | 206/564 |
| 4,281,469 | 8/1981 | Feibelman | 206/566 |
| 4,413,136 | 11/1983 | Nibling | 206/459 |
| 4,420,084 | 12/1983 | Whelan | 206/566 |

FOREIGN PATENT DOCUMENTS

| | | | |
|---|---|---|---|
| 265946 | 9/1913 | Fed. Rep. of Germany | 38/102.2 |

*Primary Examiner*—William Price
*Assistant Examiner*—Brenda J. Ehrhardt
*Attorney, Agent, or Firm*—Harpman & Harpman

[57] ABSTRACT

A jewelry holding device is disclosed for holding jewelry having a post configuration, such as earrings and the like. The device has a frame with a mesh or woven cloth stretched thereacross providing a relatively large surface area in which the jewelry posts are inserted and held by the relative friction between the post and the mesh covering.

1 Claim, 3 Drawing Figures

JEWELRY HOLDING DEVICE

BACKGROUND OF THE INVENTION

1. Technical Field

This device relates to jewelry holder and display structures that store and display the jewelry in a spaced uniform storage plane for ease of visibility and selection.

2. Description of Prior Art

Prior art devices of this type have relied on a variety of different structural configurations to hold and display jewelry. See for example U.S. Pat. Nos. 4,181,224, 4,099,611 and 4,420,084.

In U.S. Pat. No. 4,181,224, a pierced earring holder is disclosed having a stand and a multiple layer earring engagement and retaining medium. The multiple layer medium has layers of sheet plastic with layers of filler material therebetween which engages and holds the posts of the earrings.

U.S. Pat. No. 4,099,611 shows a jewelry display device having a support with a recess to accept an insert made of a plastic sheet material with tabs perforated therein to hold a variety of different sized articles. A pad decorative cushioning material is applied to the insert for support and protection.

In U.S. Pat. No. 4,420,084 a jewelry holding device is disclosed wherein a rigid sheet is mounted in a frame structure. The sheet has a plurality of aligned apertures within to receive and hold jewelry thereon.

SUMMARY OF THE INVENTION

A jewelry holding device for spacingly positioning and holding jewelry having a post configuration, such as a pierced earring in a single plane in relation to the holder. The jewelry is inserted into the holder and is retained by the friction between the posts and support material.

DESCRIPTION OF THE PREFERRED EMBODIMENT

Figure 1:
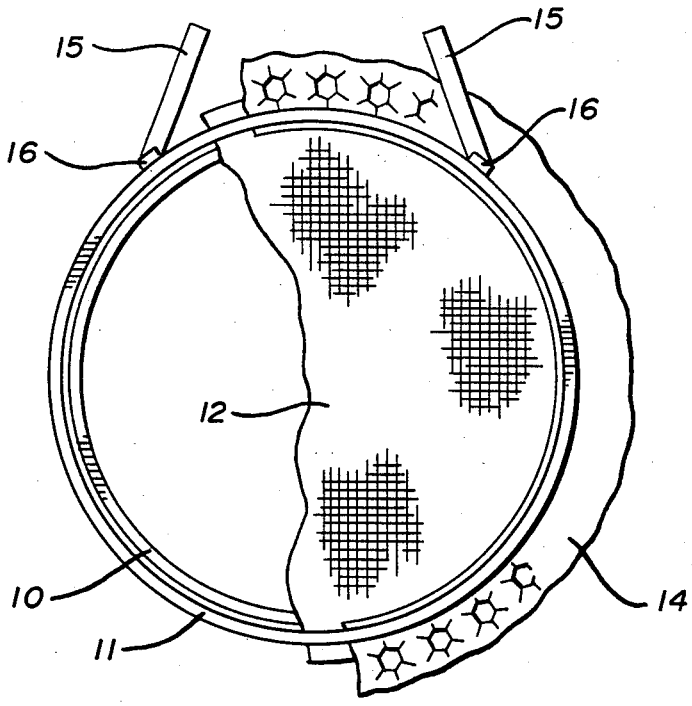
FIG. 1 is a front plan view of the device having a decorative border and support shape.

A jewelry holding device for retaining and displaying jewelry in an open and accessible manner comprises in its preferred form a pair of interlocking hoops 10 and 11 wherein the hoop 10 is of a size slightly smaller than the inner diameter of said other hoop 11 so that they will lock together when engaged one within the other.

A flexible mesh screen 12 is positioned across the hoop 10, the screen 12 having a relatively small mesh size to engage and hold jewelry, in this example pierced earrings 13. An ornamental lace annular band 14 is placed over and around the mesh screen 12 along its perimeter edge. The outerlocking hoop 11 is secured to the hoop 10 wedgeably retaining the mesh screen 12 and the lace border 14 therebetween. The mesh screen 12 is stretched tight during the above described assembly with the relationship between the screen, lace, and locking hoops clearly shown in FIG. 2 of the drawings.

It will be evident that the lace 14 will extend outwardly from the locking hoops 10 and 11 defining a decorative border as seen in FIG. 1 of the drawings.

An apertured fabric support strap 15 can be seen in FIG. 1 extending from an oppositely disposed fitting 16 positioned adjacent the upper portion of the jewelry holding device so that the same can be conveniently supported in an elevated manner.

Figure 3:
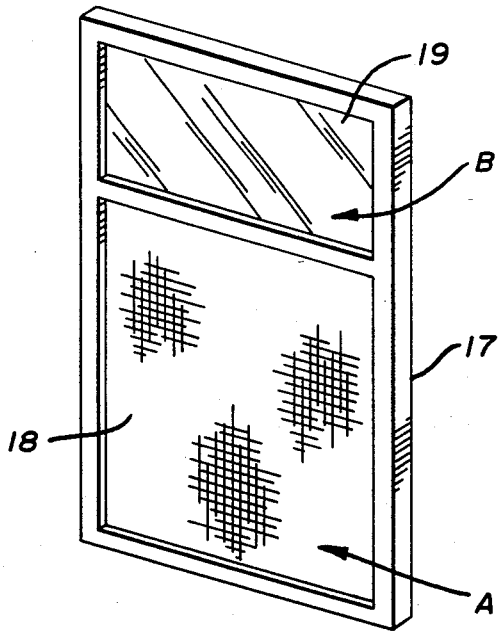
FIG. 3 is a perspective view of an alternate form of the invention having a makeup mirror included within.

Referring now to FIG. 3 of the drawings, an alternate form of the invention can be seen wherein a rectangular frame 17 is divided into a jewelry holding portion A and a mirror portion B. The jewelry holding portion A has a flexible mesh screen 18 stretched tight within the frame 17 secured by fasteners (not shown) as will be well understood by those skilled in the art. The screen 18 will retain jewelry having a post configuration in the same manner as hereinbefore described.

The mirror portion B has a rectangular mirror 19 positioned within and is conveniently positioned so as to provide viewing for the user when adjacent the jewelry retaining portion.

Figure 2:
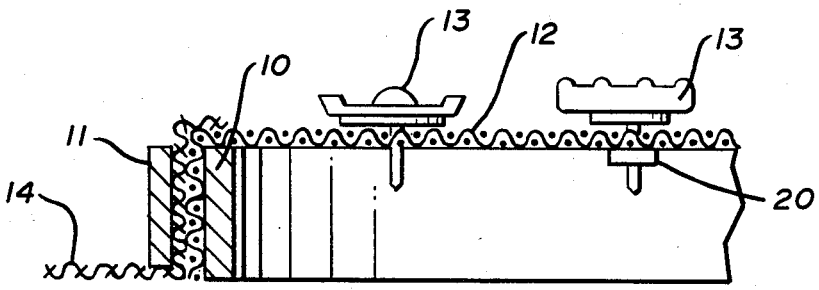
FIG. 2 is a partial cross section of the device of FIG. 1 of the drawings.

In operation, the user can simply push the pierced earrings 13 through the screens 12 or 18 and they will be retained within. An alternate use is to position the pierced earring through the mesh screen 12 and secure a post clip 20 as seen in FIG. 2 of the drawings.

It will thus be seen that a new and useful jewelry holder device has been illustrated and described and it will be obvious to those skilled in the art that various changes and modifications may be made therein without departing from the spirit of the invention and having thus described my invention,

What I claim is:

1. A jewelry holding and display device comprising in combination a flexible mesh screen for receiving and holdling an article to be displayed and a support frame for said flexible mesh screen, said support frame comprises a pair of interdependent coaxially arranged hoops supporting said flexible mesh screen therebetween, an annular band of decorative material positioned between said interdependent hoops and extending downwardly and horizontally outwardly therefrom to be parallel with said mesh screen, said band of material wedgably retaining said flexible mesh screen between said interdependent hoops.

* * * * *